US007192058B2

(12) United States Patent
Fleming

(10) Patent No.: US 7,192,058 B2
(45) Date of Patent: Mar. 20, 2007

(54) ILLUMINATED SKI POLE DISCS

(75) Inventor: Larry E. Fleming, Sand Springs, OK (US)

(73) Assignee: Snow Stamps L.L.C., Tulsa, OK (US)

( * ) Notice: Subject to any disclaimer, the term of this patent is extended or adjusted under 35 U.S.C. 154(b) by 0 days.

(21) Appl. No.: 11/239,931

(22) Filed: Sep. 30, 2005

(65) Prior Publication Data

US 2006/0163866 A1 Jul. 27, 2006

Related U.S. Application Data

(60) Provisional application No. 60/646,068, filed on Jan. 21, 2005.

(51) Int. Cl.
*A63C 11/22* (2006.01)

(52) U.S. Cl. ..... 280/824; 280/819; 362/102; 362/800

(58) Field of Classification Search ..... 280/824, 280/809, 816, 819, 821; 135/66, 910, 65; 362/102, 109, 157, 184, 249, 800
See application file for complete search history.

(56) References Cited

U.S. PATENT DOCUMENTS 4,023,817 A * 5/1977 Lah et al. ..... 280/816
4,066,889 A * 1/1978 Hodgson ..... 280/816
4,129,311 A * 12/1978 Hodgson et al. ..... 280/816
4,148,096 A * 4/1979 Haas et al. ..... 362/252
4,206,445 A * 6/1980 Steinhauer ..... 340/321
D315,591 S 3/1991 Ehlert
D316,132 S 4/1991 Ehlert
5,039,128 A 8/1991 Romuno
5,056,821 A * 10/1991 Fierro ..... 280/816
5,149,489 A * 9/1992 Crews ..... 362/570
5,271,640 A * 12/1993 Potochick et al. ..... 280/816
5,588,735 A * 12/1996 Harada ..... 362/102
6,152,491 A * 11/2000 Queentry ..... 280/819
6,265,984 B1 * 7/2001 Molinaroli ..... 340/815.4
6,485,380 B2 * 11/2002 Spangler et al. ..... 473/521
6,573,834 B1 * 6/2003 Grimani et al. ..... 340/573.1
6,612,713 B1 * 9/2003 Kuelbs ..... 362/102
2003/0142506 A1 * 7/2003 Deutsch ..... 362/500
2005/0102733 A1 * 5/2005 Holmberg et al. ..... 2/171
2005/0211284 A1 * 9/2005 Dooley ..... 135/65
2006/0128354 A1 * 6/2006 Carle et al. ..... 455/404.1

FOREIGN PATENT DOCUMENTS

JP 05177027 7/1993

* cited by examiner

*Primary Examiner*—J. Allen Shriver
(74) *Attorney, Agent, or Firm*—Fitzpatrick, Cella, Harper & Scinto

(57) ABSTRACT

A ski pole disc is provided for attachment to a ski pole. The ski pole disc includes a body extending in a direction substantially perpendicular to the ski pole and having a hole in a central portion thereof to receive the ski pole. An electronic circuit is positioned in the body, and the body is configured to allow illumination generated by the electronic circuit to be visible through the body.

38 Claims, 9 Drawing Sheets

ILLUMINATED SKI POLE DISCS

CROSS-REFERENCE TO RELATED APPLICATIONS

This application claims the benefit of U.S. Provisional Patent Application No. 60/646,068, filed Jan. 21, 2005, which is incorporated herein by reference in its entirety.

BACKGROUND OF THE INVENTION

1. Field of the Invention

This invention relates to an illuminated ski pole disc for use on a ski pole that functions to provide snow resistance when a skier thrusts the pole into the snow. The illuminated ski pole disc may alternatively or also emit sound, form or imprint an information-imparting image in the snow, and/or have an information-imparting top surface. The invention also relates to methods of imparting information and advertising.

2. Related Art

Ski poles are used by snow skiers to help balance themselves as they ski over uneven terrain or around curves. A conventional ski pole has a bottom end and a top end having a handle area by which the ski pole is manipulated by the user. A disc, sometimes referred to as a basket or wheel, is employed near the bottom end of the ski pole to provide snow resistance, and thus a measure of support, when the user thrusts the pole into snow.

Various geometrical designs have been employed for ski pole discs. The typical disc is circular, with a hub, an outer rim, and integral radial ribs or spokes. The hub may be plastic, metal, rubber, or the like and may be pivotally mounted to the ski pole. The rim may be plastic, metal, or similar materials, and the ribs are typically plastic or rubber. Examples of this general type of configuration are shown in U.S. Pat. No. 3,163,437 (Phillipson); U.S. Pat. No. 3,199,886 (Dover); U.S. Pat. No. 3,250,545 (Cameron); U.S. Pat. No. D169,644 (Weiss); and U.S. Pat. No. D196,847 (Miller). These conventional designs suffer from certain disadvantages. For example, they tend to be rather heavy and expensive to manufacture, provide a relatively small snow resistance, and are subject to getting caught on obstacles, such as branches and twigs. In addition, these discs are not useful for emitting light and/or sound or for forming information-imparting images in the snow. Nor do these discs provide an information-imparting top surface.

Other designs have sought to overcome the disadvantages discussed above by employing a largely solid disc, as shown, for example, in U.S. Pat. No. 3,743,311 (Giambazi); U.S. Pat. No. D279,024 (Nordgren et al.); U.S. Pat. No. D302,288 (Filice); U.S. Pat. No. D315,591 (Ehlert); U.S. Pat. No. D316,132 (Ehlert); U.S. Pat. No. D343,217 (Jarvinen); and U.S. Pat. No. D351,887 (Zimmerman). The solid discs tend to provide greater snow resistance due in part to their shape and larger surface area. However, these discs also are not useful for emitting light and/or sound or for forming information-imparting images in the snow or imparting information to a viewer of a top surface of the disc.

Illumination has been incorporated into the shaft or handle of a ski pole, as shown, for example, in U.S. Pat. No. 4,023,817 (Lah et al.); U.S. Pat. No. 4,066,889 (Hodgson); U.S. Pat. No. 4,129,311 (Hodgson); U.S. Pat. No. 4,206,445 (Steinhauer); U.S. Pat. No. 5,056,821 (Fierro); U.S. Pat. No. 5,149,489 (Crews); U.S. Pat. No. 5,271,640 (Potochick et al.); U.S. Pat. No. 6,152,491 (Queentry); and Japanese Patent Application Publication No. 05-177027. U.S. Pat. No. 5,039,128 shows a light attached to a ski. However, because these configurations involve lights installed in the shaft or handle of the ski pole, they are not designed to be readily replaceable components for use with a skier's existing ski poles and thus, are not amenable to being marketed separately as an add-on feature for existing equipment. In addition, such configurations do not have lights that are triggered automatically, nor do they have multi-color lights that operate in predetermined and/or random sequences.

SUMMARY OF THE INVENTION

In one aspect, the present invention provides a ski pole disc for attachment to a ski pole, including a body extending in a direction substantially perpendicular to the ski pole and having a hole in a central portion thereof to receive the ski pole. An electronic circuit is positioned in the body, and the body is configured to allow illumination generated by the electronic circuit to be visible through the body.

Embodiments of the present invention may include one or more of the following features.

The electronic circuit may include a motion-activated circuit, and the illumination may be initiated in response to a signal from the motion-activated circuit. The ski pole disc may include a sound generation circuit, and the generation of sound by the sound generation circuit may be initiated in response to a signal from the motion-activated circuit.

The body of the ski pole disc may include a housing. The housing may include a bottom housing element having a hole in a central portion thereof to receive the ski pole and a top housing element having a hole in a central portion thereof to receive the ski pole. The top housing element may cooperate with the bottom housing element to house the electronic circuit. The bottom housing element and the top housing element may have respective edge portions that are substantially the same size and shape, and the edge portions may be sealed together to prevent water from entering the housing. The housing may include an inner surface substantially perpendicular to the ski pole and having recessed portions configured to hold elements of the electronic circuit. The bottom housing element may be configured to allow the illumination generated by the electronic circuit to be visible through the bottom housing element.

The body of the ski pole disc may further include a resistance layer attached to the housing and extending beyond the housing in a direction substantially perpendicular to the ski pole. The top housing element and the resistance layer may be configured to allow the illumination generated by the electronic circuit to be visible through the top housing element and the resistance layer. The resistance layer and the housing both may be formed of plastic, and the resistance layer may be formed of a softer plastic than the housing.

The resistance layer may be formed on top of or beneath the housing by injection molding. The resistance layer may be formed around the housing by injection molding to at least partially cover the top and bottom of the housing. The resistance layer may be configured to form an image in the snow that imparts information to a person viewing the formed image. The resistance layer may be configured to impart information to a person viewing a top surface of the resistance layer.

The electronic circuit of the ski pole disc may include light-emitting devices and a processor configured to control the light-emitting devices in a predetermined sequence. The electronic circuit may be formed on printed circuit boards (PCBs) arranged around the periphery of the body. The light-emitting devices arranged on each of the PCBs may include a variety of colors. The light-emitting devices may be light emitting diodes (LEDs).

The electronic circuit may further include a power source connected to provide power to the light-emitting device and the processor. The power source may include a battery or batteries, which may be arranged around a periphery of the housing. The power source may include a number of batteries arranged in a stack. The power source may include a solar cell connected to recharge the power source.

In another aspect, the invention provides methods of imparting information and advertising. In the information-imparting aspect, the disc may include a bottom surface configured to form an image in the snow that imparts information to a person viewing the formed image and/or a top surface that imparts information to a person viewing that surface.

Embodiments of the present invention also may include one or more of the following features. The lights (or single light) may be activated by motion and/or impact of the ski pole. The lights may be activated by temperature or a light-level detector. The lights may be continuous or flashing, including various timings, patterns and sequences of flashing. There may be a plurality of sets of LEDs, each set being provided in a lighting housing installed in the disc. There may be four sets of LEDs, each set having three LEDs, but this is merely one example of a possible configuration. Various numbers of LEDs, in various groupings, are possible. The lights may be powered by a battery or plurality of batteries installed in the disc.

In other embodiments, the ski pole disc may emit a sound or sounds in addition to or in lieu of light. The sound or sounds may, for example, impart information, may be nonsensical, or may be a voice and/or music message.

In other embodiments, the imparted information may be at least one of commercial information, advertising, political information, personal identification, organizational identification, and team identification information. The formed image may include a text portion and/or a pictorial portion. The formed image also may include a logo. A ski pole may be provided that includes the disc.

These and other objects, features and advantages will be apparent from the following description of the preferred embodiments of the present invention.

DETAILED DESCRIPTION OF THE PREFERRED EMBODIMENT

The ski pole disc of the present invention, in addition to providing snow resistance when a skier thrusts the pole into the snow, also has an illumination system to emit continuous or flashing lights. As further discussed below, the lights may be activated by the motions of the skier as he or she uses the ski poles via an LED circuit embedded in the ski pole disc. The LED circuit may be powered by a battery or batteries that are also embedded in the ski pole disc.

The ski pole disc is designed to accommodate a housing (or housings) of the LED circuit (or circuits) and battery (or batteries). The disc may be decorated to allow the product to be offered in attractive colors, and may be opaque, translucent, or transparent. Additionally, the illuminated ski pole disc may be designed to utilize any or all of the designs discussed below for imparting information.

The lights may be motion-activated, so as to be activated for a specific time to allow the lights to go on and off as the skier uses the ski pole. Alternatively, the lights may stay on continuously or for a relatively long duration. These design decisions may be made prior to manufacture of the ski pole disc and may or may not be features that are adjustable by a user. Of course, the lights may be multi-colored or of a single color. The ski pole disc also may be designed to generate a sound or sounds, in addition to light or in lieu of light. These sounds may be, for example, non-intelligible noises, an information-imparting sound, a voice message or music.

Figure 1:
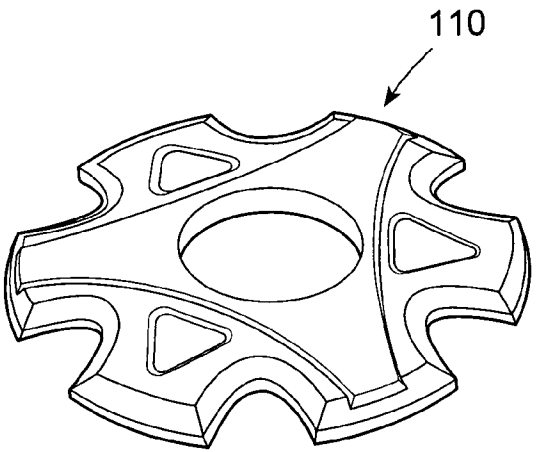
FIG. 1 is a top perspective view of a resistance layer of an illuminated ski pole disc in accordance with an embodiment of the present invention.

As shown in the particular embodiment of FIG. 1, the illuminated ski pole disc 100 has a snow resistance layer 110 having a generally round shape with a scalloped outer edge, e.g., round with a number of concave cutout portions 115. However, a nearly infinite variety of shapes is possible, as further discussed below. The resistance layer 110 has openings 120, or portions that are translucent or transparent, to allow the lights installed in the disc to be visible from the top of the disk. The resistance layer also has an opening 130 in the center to allow installation of the disc onto a ski pole, as further discussed below.

Figure 2:
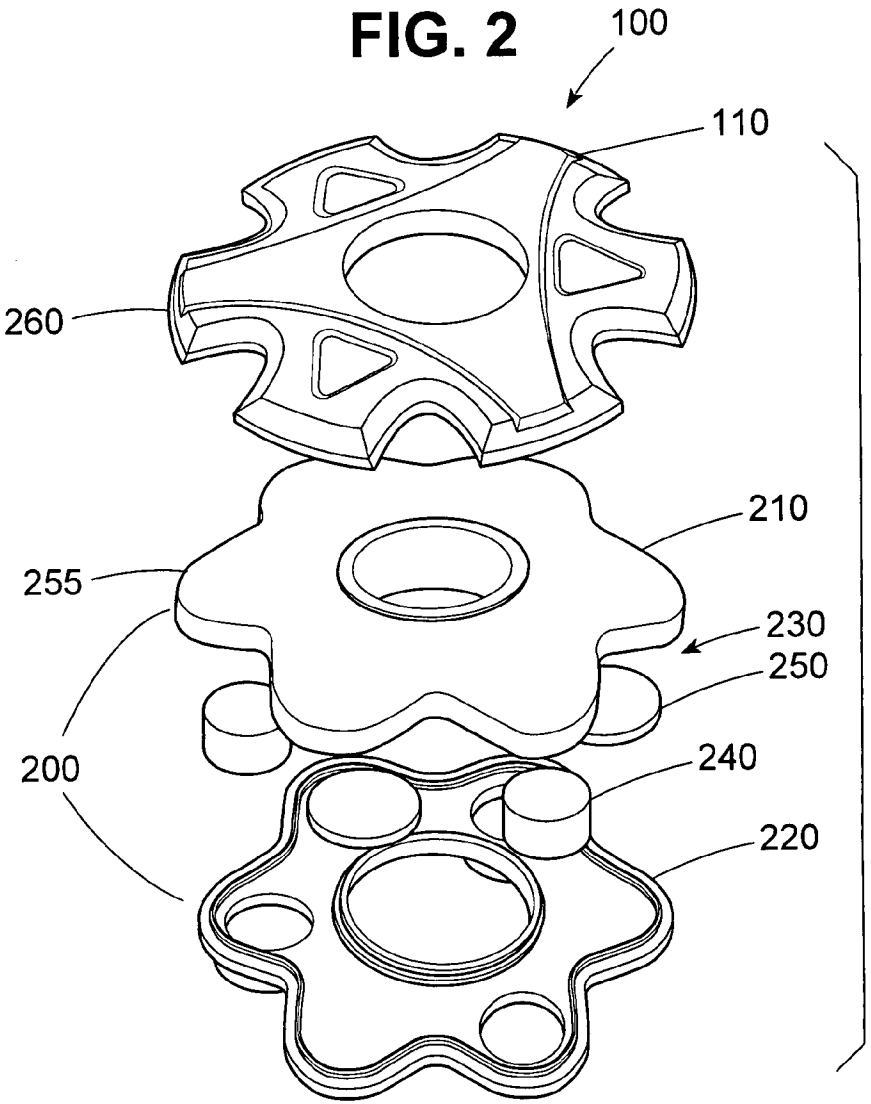
FIG. 2 is an exploded perspective view of the illuminated ski pole disc.

As shown in FIG. 2, a housing 200, having a top housing element 210 and a bottom housing element 220, is positioned beneath the resistance layer 110 of the disc 100 to enclose an electronic circuit, such as for example, an illumination circuit 230. The illumination circuit includes an arrangement of batteries 240, printed circuit boards (PCBs) 250 and wiring (not shown in this view) that is sealed in the housing 200. The housing 200 is similar in shape to the resistance layer 110, but may be somewhat smaller. In this particular embodiment, the protruding points 255 around the outer edge of the housing have a more rounded shape than the corresponding protruding structures 260 of the resistance layer 110.

The housing 200 may be formed of any appropriate translucent or transparent material, such as for example plastic. The housing 200 also may be formed of an opaque material, e.g., plastic, metal, etc., with translucent or transparent windows formed therein. In this embodiment, the top 210 and bottom 220 housing elements are formed of a hard, translucent plastic, e.g., polypropylene, in an injection molding process and are sealed together so as to form a waterproof housing 200 for the illumination circuit 230. The top 210 and bottom 220 housing elements may be sealed in a number of ways, such as for example by ultrasonic welding or adhesive. The top 210 and bottom 220 housing elements may include edges that are configured to provide a snap fit between the elements. The snap fit may be augmented by, for example, adhesives, sealants, or a coating to ensure a waterproof fit.

Once the housing 200 has been sealed with the illumination circuit 230 inside, the resistance layer 110 is formed on the housing 200. For example, the resistance layer 110 may be formed using a second injection molding process in which the housing 200 is inserted into the injection molding machine and the resistance layer 110 is molded over the top surface of the top housing element 210. Alternatively, the resistance layer 110 may be formed separately (e.g., using injection molding) and attached to the housing 200 using adhesive. Alternatively, the resistance layer 110 may be attached to or molded over the top surface of the top housing element 210 alone, and then, after the electronic circuit 230 is installed in the housing 200, the top 210 and bottom 220 housing elements may be sealed together, e.g., by ultrasonic welding or adhesive. The top surface of the top housing element 210 may have holes or ridges formed therein to accept material from the resistance layer 110 during the molding process, thereby providing an interlocking fit between the housing 200 and the resistance layer 110.

The resistance layer 110 may be formed of any suitable material, but in this embodiment, it is formed of plastic that is somewhat softer than the plastic of the housing 200, e.g., thermal polyethylene. The softer material allows the resistance layer 110 to function in a manner similar to a traditional ski pole disc or basket, in that it is flexible and can withstand the shock and abuse associated with ski pole use. As noted above, the resistance layer 110 may be transparent or translucent, or may be opaque with widows or openings 120 (see FIG. 1). The resistance layer 110 may be provided in wide array of colors and shapes.

Figure 3:
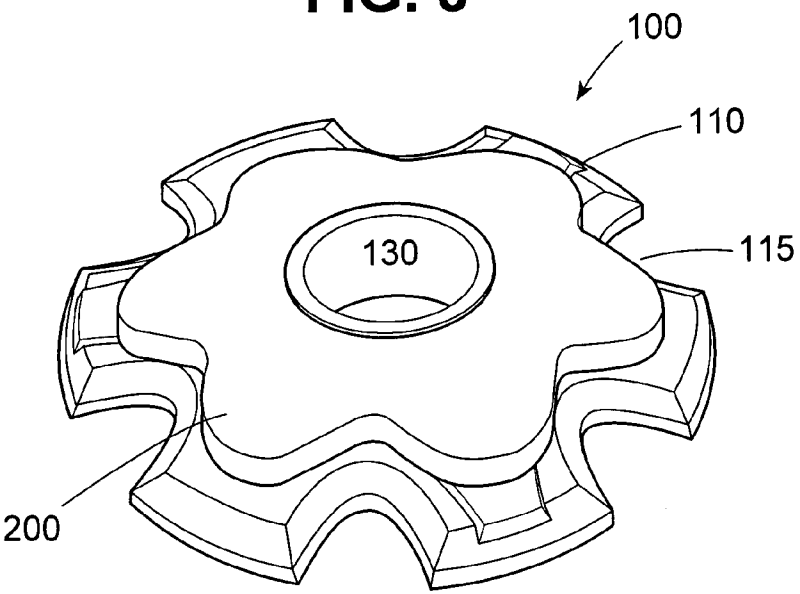
FIG. 3 is a top perspective view of an embodiment in which the resistance layer is formed on the bottom of the housing.

In an alternative embodiment, as shown in FIG. 3, the resistance layer 110 may be formed on the bottom of the housing 200. For example, the resistance layer 110 may be formed using a second injection molding process in which the housing 200 is inserted into the injection molding machine on top of the resistance layer 110 and the resistance layer is molded to the bottom surface of the bottom housing element 220. Alternatively, the resistance layer 110 may be formed separately (e.g., using injection molding) and attached to the bottom surface of the bottom housing element 220 using adhesive. In this alternative embodiment, the resistance layer 110 may be opaque, as the illumination would be visible through the top housing element 210. In addition, the resistance layer 110 may be attached to or formed on the bottom housing element 220 alone, and then, after the electronic circuit 230 is installed in the housing 200, the top 210 and bottom 220 housing elements may be sealed together, e.g., by ultrasonic welding or adhesive.

Figure 4:
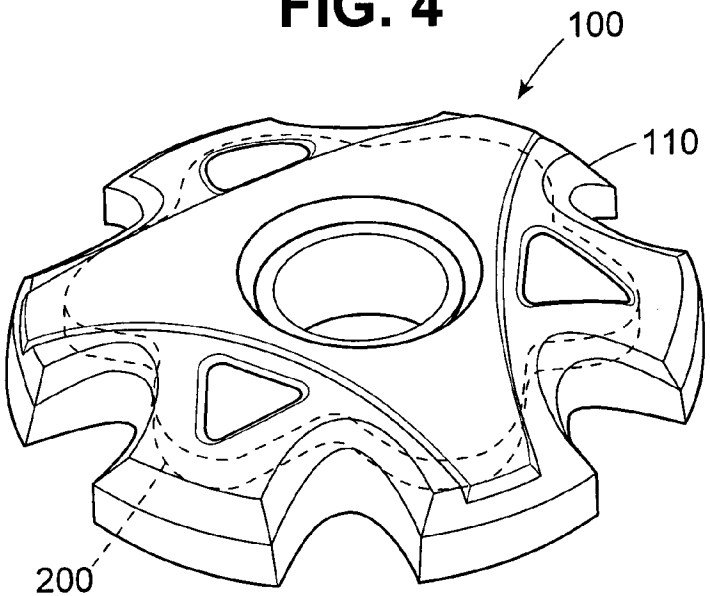
FIG. 4 is a top perspective view of an embodiment in which the resistance layer is formed on the top and bottom of the housing.

In a further alternative embodiment, as shown in FIG. 4, the resistance layer 110 may be formed such that both the top 210 and bottom 220 housing elements are at least partially enclosed within the resistance layer 110. For example, the second injection molding process may be conducted so that the resistance layer 110 is formed over the top 210 and bottom 220 elements of the housing 200 and extends beyond the periphery of the housing 200 to form the outer surface of the ski pole disc. In such a case, the resistance layer 110 may have transparent or translucent portions or cut-out portions to allow the illumination to be visible through the resistance layer.

In other embodiments, the ski pole disc 100 may not have a resistance layer 110 at all, in which case the housing 200 may be formed with an extended edge portion to provide snow resistance. The extended edge portion may be provided on the top housing element 210, bottom housing element 220, or both.

Figure 5:
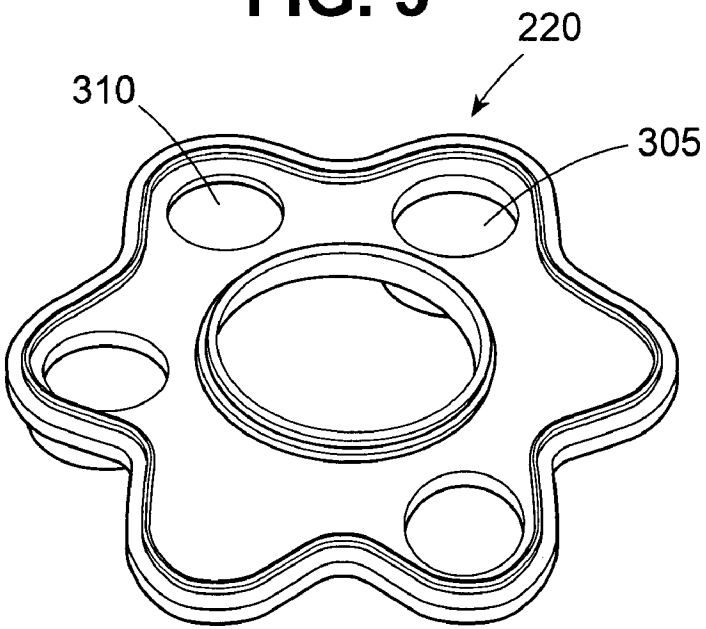
FIG. 5 is a top perspective view of the bottom housing element.

FIG. 5 shows the bottom housing element 220, which, in this embodiment, has a number of recesses 305, 310 formed on the periphery thereof to hold batteries 240 and PCBs 250 in place. For example, the bottom housing element 220 may have three cylindrical recesses 305 with a diameter of about 0.5 inches and a depth of about 0.125 inches configured to hold the batteries 240. The recesses 305 may be sized to provide a snug fit for the batteries 240, or may allow room for different battery types to be used. The battery recesses 305 may include a cylindrical metal lining (not shown) that extends partially out of the recess 305 in order to allow electrical contact with a terminal of the battery 240. Alternatively, a battery clip (not shown) may be provided on the bottom of the recess 305 and electrically connected via a wire or other means to the illumination circuit 230. The bottom housing element 220 also may contain shallower recesses 310 configured to receive the PCBs 250, which in this embodiment, are round, but thinner than the batteries (about 30 mils thick). In an alternative embodiment, the batteries 240 may be arranged in a stack that is positioned in a recess in the housing 200.

A variety of configurations for the bottom housing element 220 are possible. Specifically, the number of recesses 305, 310 for batteries 240 and PCBs 250 can vary depending upon the number of batteries or PCBs required for a particular design. Also, recesses may not be provided for the PCBs if the space between the top 210 and bottom 220 housing elements is sufficient. In addition, recesses may be provided in the top housing element 210 in lieu of or in addition to the recesses in the bottom housing element 220. In alternative embodiments, the batteries 240 may be positioned in recesses, and the PCBs 250 may be positioned directly over the batteries, such that a contact on the underside of the PCB makes an electrical connection with a terminal of the battery.

Figure 6:
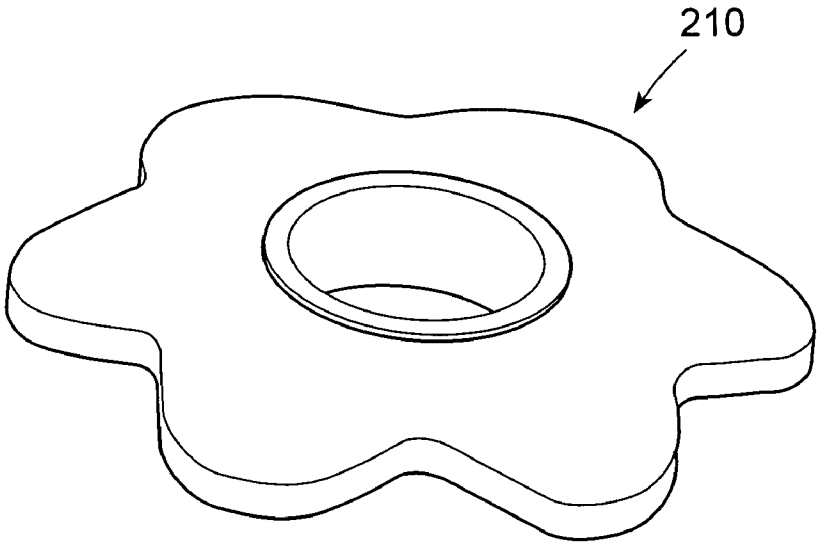
FIG. 6 is a top perspective view of the top housing element.

The top housing element 210, as shown in FIG. 6, is similar in shape to the bottom housing element 220. As noted above, the top housing element 210 may have recesses formed therein (not shown) for receiving illumination circuit 230 components, e.g., batteries 240 and PCBs 250. In this embodiment, the top housing element 210 is a translucent plastic, so as to allow light generated by the illumination circuit 230 to shine through the top of the housing.

Figure 7:
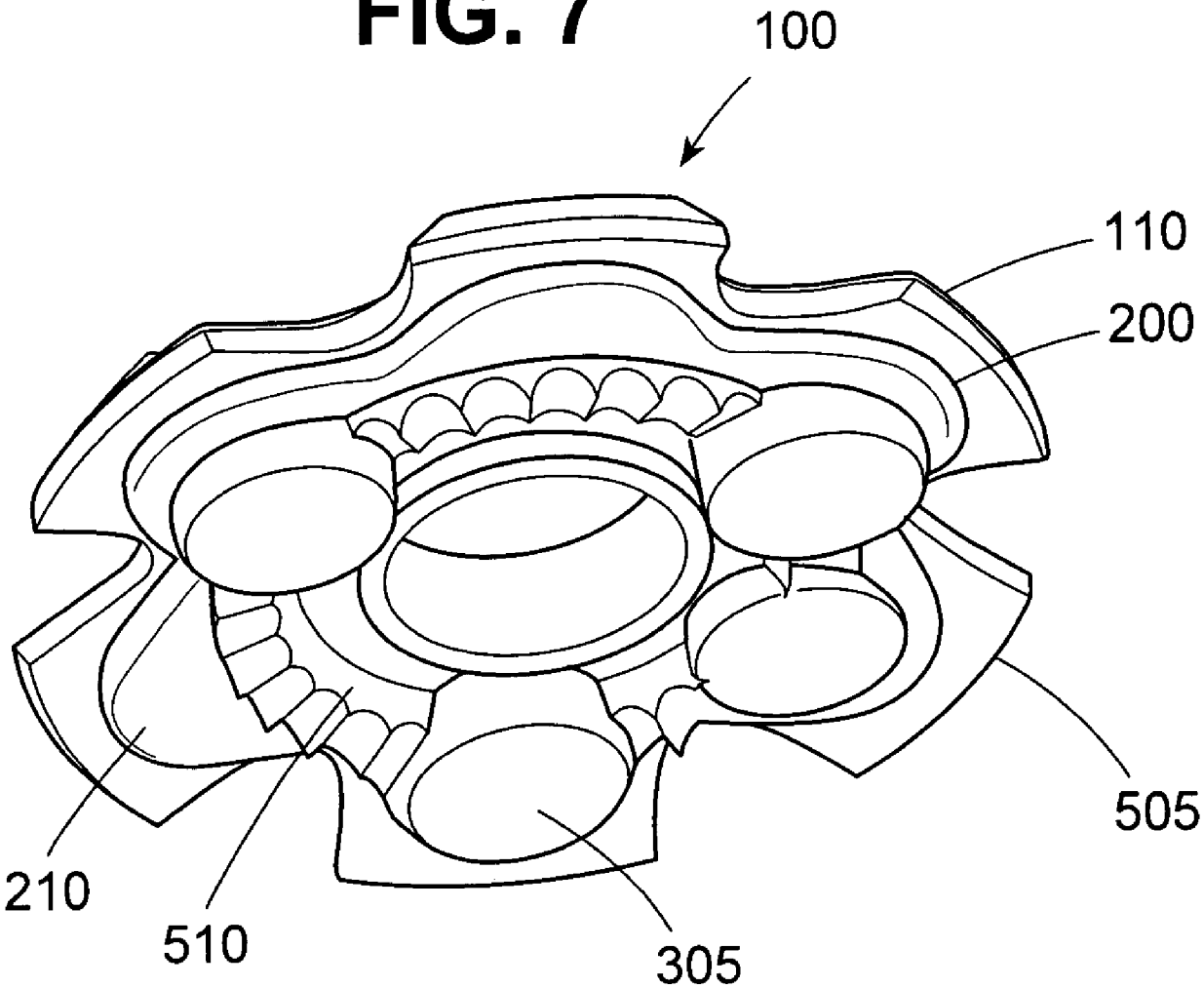
FIG. 7 is bottom perspective view of the illuminated ski pole disc.

FIG. 7 shows the underside of the ski pole disc 100, and as noted above, the resistance layer 110 may be formed on the top of the housing 200, e.g., by being injection molded onto the housing 200. In the illustrated embodiment, the resistance layer 110 is larger than the housing 200 and therefore extends outward beyond the edge of the housing. This outer portion 505 of the resistance layer 110 provides additional resistance as the pole and disc 100 are thrust into the snow during use. The outer portion 505 also serves to protect the housing 200 from shock, because it is flexible and absorbs impact. For example, if the ski pole were to impact an object, the resistance layer 110 would help prevent contact between the object and the housing 200. The bottom housing element 210 may have notches 510 formed around the periphery thereof, in order to provide additional resistance in snow and ice. Also, the recessed portions 305 holding the components of the illumination circuit 230, e.g., the batteries 240, may extend from the bottom of the housing.

Figure 8:
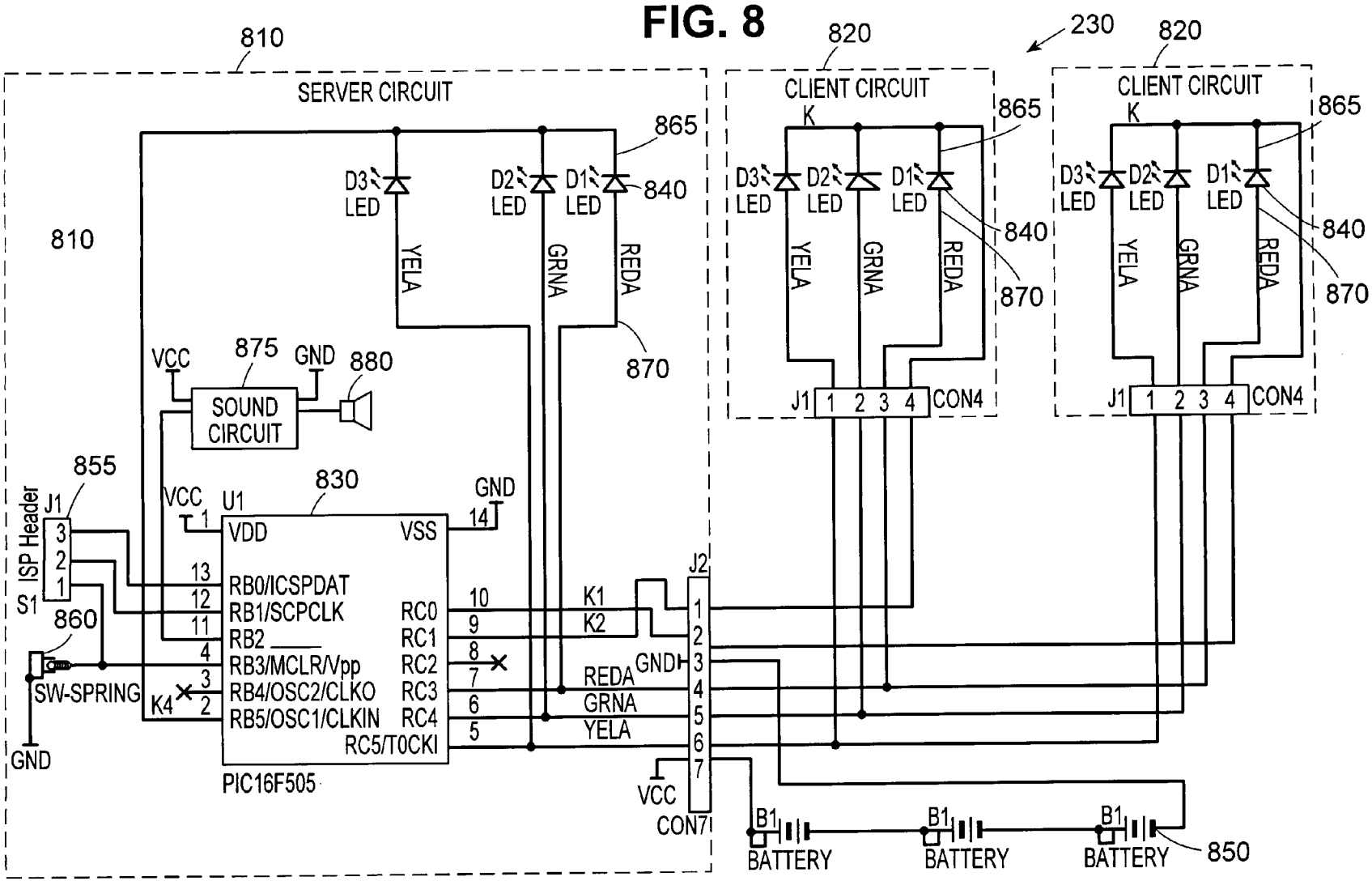
FIG. 8 is a schematic of the electronic circuit.

As shown in FIG. 8, the illumination circuit 230 of this particular embodiment includes a number of interconnected PCBs, including a "server" PCB 810 connected to two "client" PCBs 820. The server PCB 810 includes a microprocessor/microcontroller 830 ("controller"), which controls the activation of light emitting diodes (LEDs) 840 on the server and client PCBs. The number of server and client PCBs may vary depending upon various design considerations, such as for example, the size of the disc, the number of LEDs, and whether sound generation or other functionalities are included. For example, there may be one server PCB 810 and three or four client PCBs 820.

Each PCB in this embodiment, including the server 810 and the clients 820, has three LEDs 840 of multiple colors arranged on the surface thereof, e.g., one red, one yellow, and one green. Of course, a variety of colors and arrangements is possible. As a further example, there may be only one LED 840 per board, each of which is a different color, or there may be several LEDs 840 on each board of the same color, but differing from board to board. Moreover, the server PCB 810 may or may not have LEDs. The server PCB 810 may be connected to the client PCBs 820 to allow access to each individual LED 840, or may allow access in certain color/location combinations, as discussed below.

As noted above, the illumination circuit 230 also includes a power source, such as for example, a number of batteries 850, which may be positioned in recesses around the periphery of the housing 200. Each battery 850 may be connected to a client PCB 820 positioned on top of the battery 850 (e.g., via a contact on the underside of the PCB) or adjacent to the battery 850 (e.g., via a wired connection). For example, there may be three batteries 850, one associated with each of the server PCB 810 and two client PCBs 820. Each client PCB 820 may, in turn, be connected to a power supply input (Vcc) of the server PCB 810, which provides power for the entire illumination circuit 230. Alternatively, the batteries 850 may be connected directly to the server PCB 810, e.g., via a wired, series connection. The controller 830 on the server PCB, in turn, provides the power to illuminate all of the LEDs 840, as further discussed below.

Referring again to FIG. 8, the controller 830 may be an in-circuit programmable controller with flash memory, for example, a PIC16F505, supplied by Microchip Technology, Inc. of Chandler, Ariz. The controller 830 has a number of bi-directional input/output (I/O) pins (RB0–RB5 and RC0–RC5), which output signals to drive the LEDs 840, as described below. The controller 830 also has in-circuit serial programming input pins (ICSDAT, ICSPCLK, and Vpp), which may be accessible via a connector 855 to allow the controller 830 to be programmed during manufacture.

A switch 860 is connected to a reset port (MCLR) of the controller 830 to allow initiation of the program that controls the illumination of the LEDs 840 or other functionalities of the disc (e.g., sound generation). As noted above, the switch 860 may be motion-activated and may include a spring-loaded element. For example, the switch 860 may be implemented as a spring with a weighted end that is configured to bounce against an electrical contact (or multiple contacts) in response to motion of the disc. The sensitivity of the switch 860 is set to ensure that the device is not too easily activated, which may be annoying to the user and would tend to deplete the power source too quickly. Also, the switch 860 is not so insensitive as to require an undue movement of the disc to initiate the illumination sequence. Rather, the switch 860 is calibrated to be activated by the normal motions of skiing, so that the illumination sequence occurs frequently while the user is skiing, but does often occur when the ski pole disc is being transported or stored.

In the embodiment of FIG. 8, one of the terminals (e.g., the cathode 865) of each LED is connected to a single control line (K1, K2, and K4) on each PCB so as to be activated together, which lessens the number of connections between the server PCB 810 and client PCBs 820. The opposite terminal (e.g., the anode 870) of each LED 840 is connected to an individual control line (REDA, GRNA, YELA), each corresponding to a particular color, e.g., red, green, and yellow. Thus, each PCB 810, 820 has one common control line (K1, K2, and K4) and three individual color control lines (REDA, GRNA, YELA). As an alternative, the LEDs 840 of a particular color on each PCB, e.g., all of the green LEDs, may be connected to be activated together.

Individual control of each LED 840 on each PCB 810, 820 may be achieved by using pulse-width modulation (PWM) control waveforms to provide time-division multiplexing of the control signals. For example, to activate a red LED on one client PCB and a green LED on another client PCB, the red LED control (REDA) and green LED control (GRNA) are activated using alternating PWM pulses, while the single control lines (K1 and K2) are also activated using alternating PWM pulses (e.g., such that the K1 and REDA pulses are coincident and the K2 and GRNA pulses are coincident, but offset in time from the K1 and REDA pulses). As an alternative, a controller 830 with more numerous control outputs may be used, such that the outputs are connected to each individual LED 840 on each of the client PCBs 820, as well as on the server PCB 810.

PWM may also be used to control the brightness of the LED illumination. For example, PWM control waveform having an activation duty cycle of, e.g., about 20%, may be used to provide a desired level of illumination. Thus, PWM waveforms allow individual control of the LEDs, allow level control without requiring resistive elements, and lessen the overall system power requirements.

As noted above, the controller 830 runs a control program configured to illuminate the LEDs 840 in a predetermined sequence. In this embodiment, the LEDs 840 of each PCB 810, 820 are illuminated briefly in sequence, e.g., red, green, blue, one board at a time. The order of the colors corresponds to the positions of the LEDs, such that the light appears to progress in a circle around the PCB. The sequence starts with one PCB and then progresses around the periphery of the disc 100 until the LEDs of all of the PCBs have been illuminated. Thus, the light appears to follows a circular motion around the periphery of the disc 100, as well as around each individual PCB 810, 820. Then, the LEDs 840 of all of the PCBs 810, 820 are illuminated in this predetermined color sequence at the same time. In other words, all of the red LEDs are activated, followed by all of the green LEDs, followed by all of the blue LEDs, and this sequence is more rapid than the initial sequence. Of course, there are numerous possible sequences, involving different order and timing of illumination. The controller also may be programmed to generate random sequences or combinations of predetermined and random sequences.

In addition to LEDs 840, the server 810 and/or client 820 PCBs may include sound generation circuit 875 and, a sound emitting device, such as for example, a speaker 880 or simple buzzer. The speakers 880 may be individually or collectively controlled by the sound generation circuit 875 using connections similar to those discussed above for control of the illumination. Alternatively, separate speakers may be provided in recesses around the periphery of the housing 200. The sound generation circuit 875 may be programmed to emit a sequence of noises or sounds or music from the speakers 880 in concert with the illumination sequence.

Figure 9:
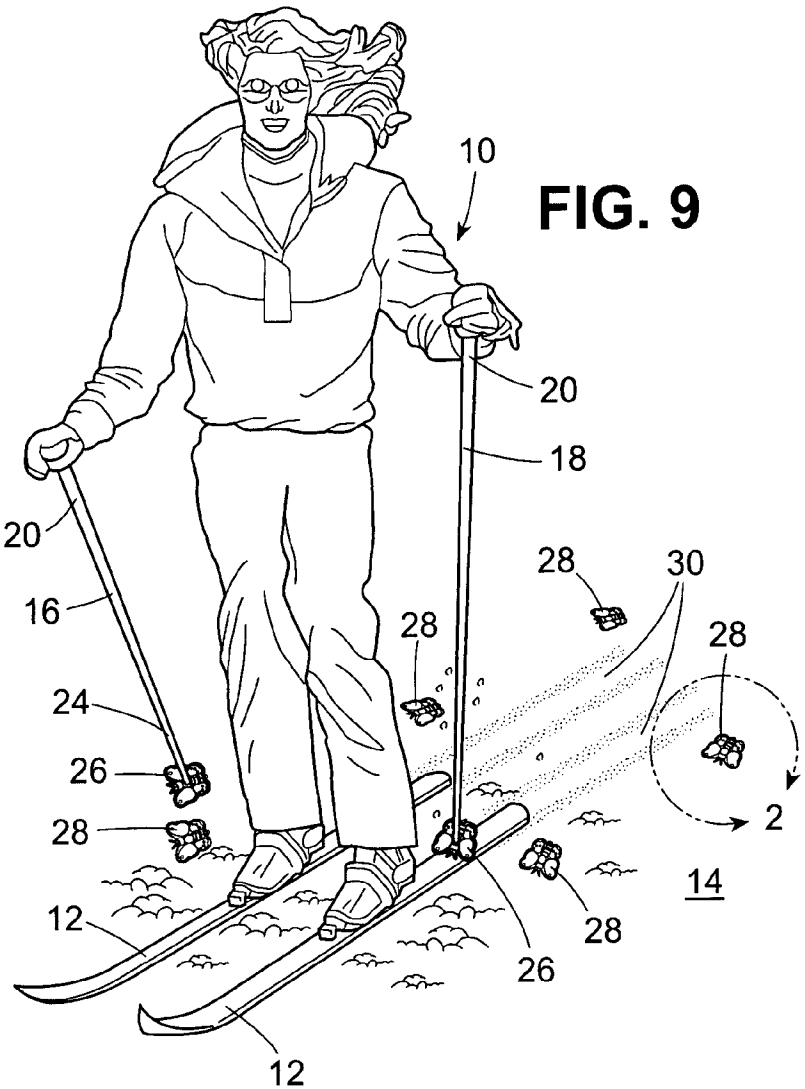
FIG. 9 is an isometric illustration of a skier moving on skis over a snow surface and employing ski poles in both her left and right hands.

In addition to the illumination and sound-emitting features discussed above, the ski pole disc 100 of the present invention also may incorporate image-imparting features, as shown in FIGS. 9–16. FIG. 9 shows an example of the use of an image-imparting ski pole disc with illumination and/or sound features by a skier 10 having skis 12 and moving over a snow surface 14. The skier 10 is shown using two ski poles 16, 18, one in each hand. The ski poles 16, 18 are elongated and have a top end portion 20 and a bottom end portion 24. Affixed to each of the ski poles 16, 18, at the bottom end portion 24, is an image-imparting ski pole disc with illumination and/or sound features 26.

In the illustration of FIG. 9, each of the ski pole discs 26 imprints the snow surface 14 with an image that imparts information to someone viewing the image. The imparted information conveyed in the image may include, for example, commercial information, advertising, political information, religious information, sports-related information, nonsensical or humorous information, entertainment, style or fashion information, personal, organizational, or team identification information, etc. The image may include a likeness of a person, animal or object, and/or text, e.g., letters, numbers, words, and phrases. For example, the image may be a commercial image, e.g., a logo, with or without accompanying text, such as a name or trademark. In addition, as the skier applies normal skiing motions to the ski pole, the illumination sequence and/or sound sequence is activated, as discussed above.

In the arrangement of FIG. 9 each of the ski pole discs 26 is configured to form an image in the snow surface 14, each time the disc engages a snow surface, e.g., an image of a butterfly. That is, an imprinted image 28 is formed each time a ski pole disc 26 contacts a snow surface 14 that gives the visual impression of a butterfly. In this way, skier 10 leaves identification information along her ski tracks 30 that would help enable a skier following to identify the individual who has been along the same route previously.

Figure 10:
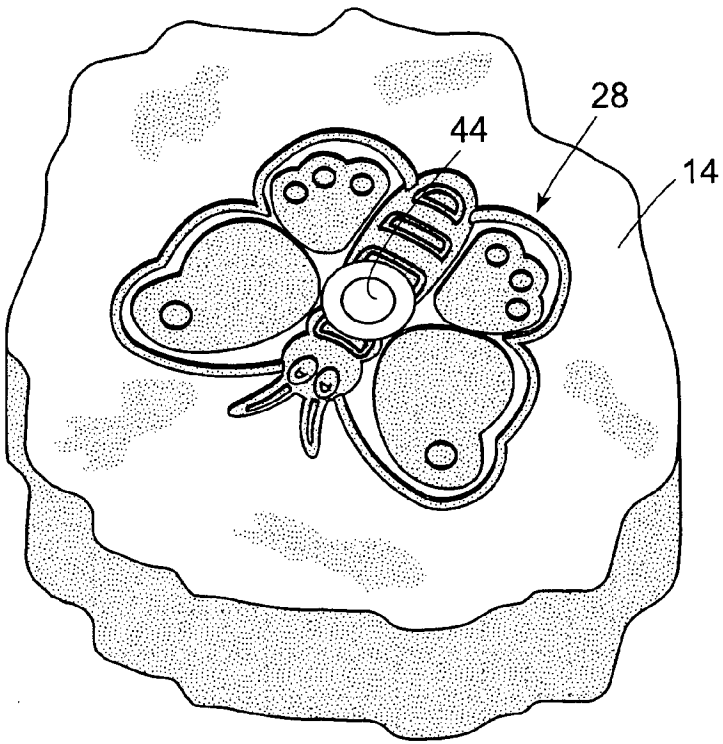
FIG. 10 is an enlarged view of a butterfly formed in a snow surface by the ski pole disc of FIG. 9.

FIG. 10 is an enlargement of one of the imprints 28 formed in snow surface 14.

Figure 13:
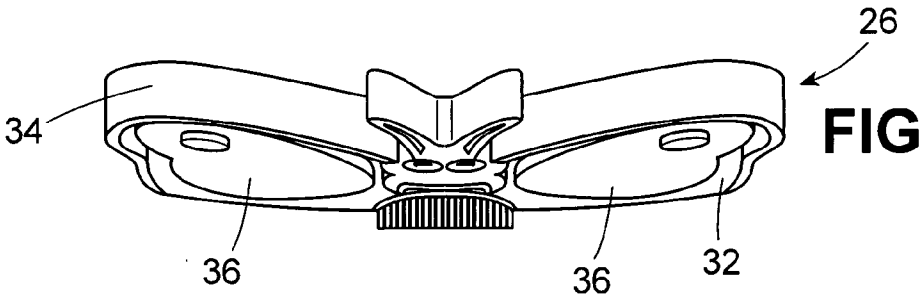
FIG. 13 is an end view, slightly isometric of the ski pole disc of FIG. 11.
Figure 11:
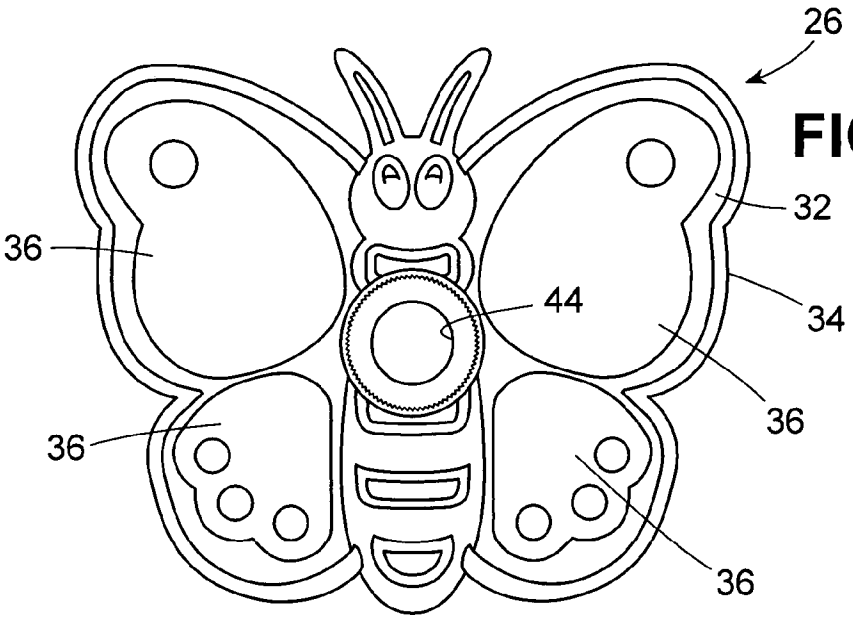
FIG. 11 is an enlarged plan view of the bottom surface of a ski pole disc, wherein an image representing a butterfly is formed in the snow surface each time the disc contacts the snow surface.
Figure 12:
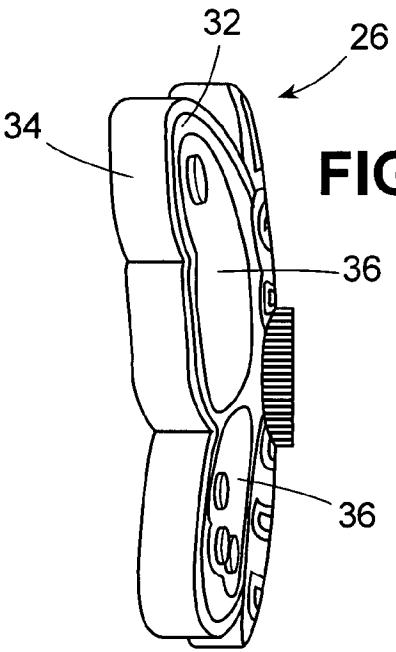
FIG. 12 is an elevation, slightly isometric side view of the ski pole disc of FIG. 11.

FIGS. 11–13 show more details of the ski pole disc 26 and shows end and side edges. FIG. 11 shows specifically the bottom surface 32 of ski pole disc 26, which may be the bottom surface of the resistance layer, if such layer is arranged on the bottom of the housing or surrounding the housing, as discussed above. The bottom surface is defined by an outer circumferential edge 34 that outlines the shape of the image that is to be imprinted in the snow surface. In this example, the circumferential edge 34 outlines the shape of a butterfly.

Formed in bottom surface 32 are a plurality of contoured recesses 36 configured to form the imprint of the intended image when the ski disc contacts snow surface 14. The recesses 36 vary in size, shape, contour, depth, and so forth, so that taken together they form a contoured bottom surface within a peripheral edge 34 that forms an image-imparting imprint when the ski pole disc contacts a snow surface. Alternatively, the imprint of the intended image may be formed by bottom surface 32 having contoured raised surfaces that act to compact the snow to form corresponding contours in the snow surface.

Figure 15:
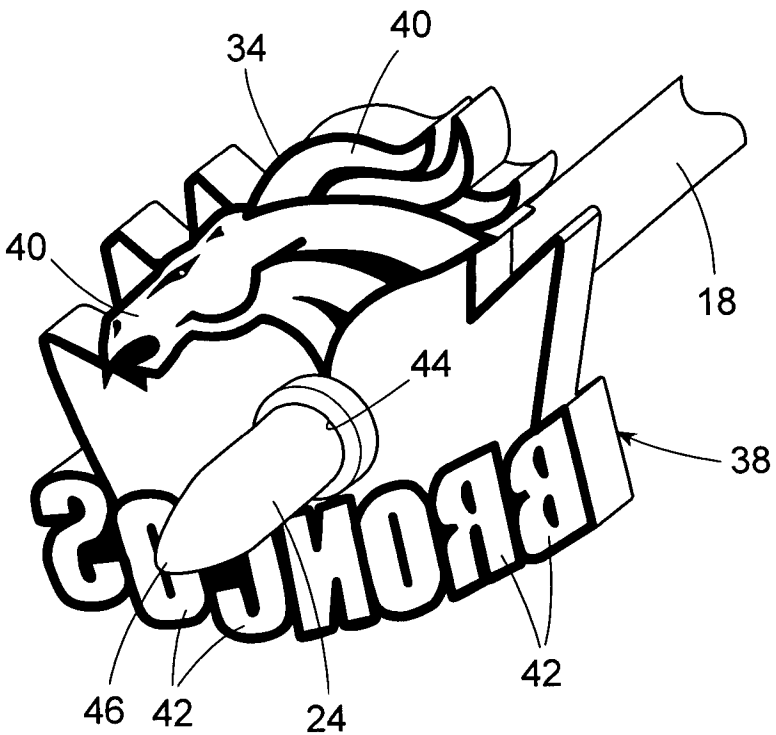
FIG. 15 is an isometric bottom view of a ski pole disc as affixed to the bottom end portion of a ski pole with the ski pole shown broken away.
Figure 14:
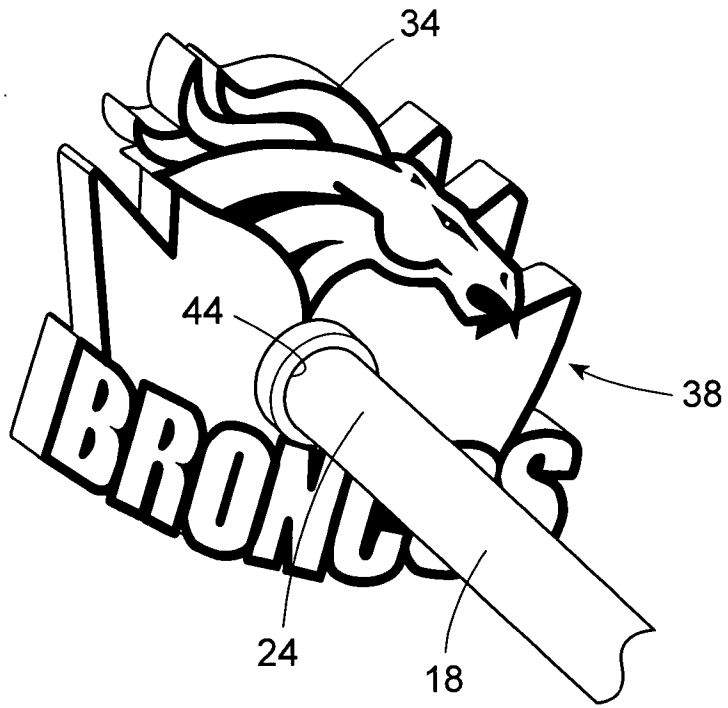
FIG. 14 is a top view of an alternate design of a ski pole disc secured to the bottom end portion of a ski pole, the ski pole being shown broken away.

FIGS. 14 and 15 show an alternative embodiment of an image-imparting ski pole disc, in this case identified by the numeral 38. FIG. 14 shows the bottom end portion 24 of a ski pole 18 having a ski pole disc 38 secured thereto. The ski pole disc 38 in FIGS. 14 and 15 is intended to provide an imprinted image in a snow surface that includes both a text portion and a pictorial portion. In this instance, the pictorial portion of the image is formed by recesses 40 of the ski pole disc 38 outlined by circumferential edge 34 that depicts the head of a horse. The text portion of the image is formed by other recesses 42 in the ski pole disc bottom surface that form the imprint of letters in the snow surface, and in this case the letters form the word "BRONCOS." The ski pole disc 38 of this embodiment also may include the illumination and/or sound features discussed above.

The ski pole disc of FIGS. 14 and 15 demonstrates how the bottom contoured surface of the ski pole disc can employ both text portions and pictorial portions to provide an image indicative of an athletic team, such as a logo. This embodiment further illustrates that the top surface of the disc also may be used to impart information. For example, the "BRONCOS" logo on the top surface will be visible to others as the skier is waiting in a lift line or using a chair lift to reach the top of the ski slope. In one embodiment, only the top surface of the disc is configured to impart information.

Ski pole discs can be secured to the bottom end of ski poles in a number of ways. For example, the disc may have a central opening 44 therethrough that receives the bottom end portion 24 of a ski pole 18. The ski pole 18 may be tapered, and the disc opening 44 may have a corresponding taper, so that when the bottom end of a ski pole is inserted into the ski pole disc, the ski pole disc is held in place by frictional engagement. FIG. 15 shows the bottom end portion 24 of a ski pole extending through the ski pole disc 38 and through opening 44 therein, with the bottom end 46 of the ski pole extending beyond the bottom surface of the ski pole disc.

Figure 16:
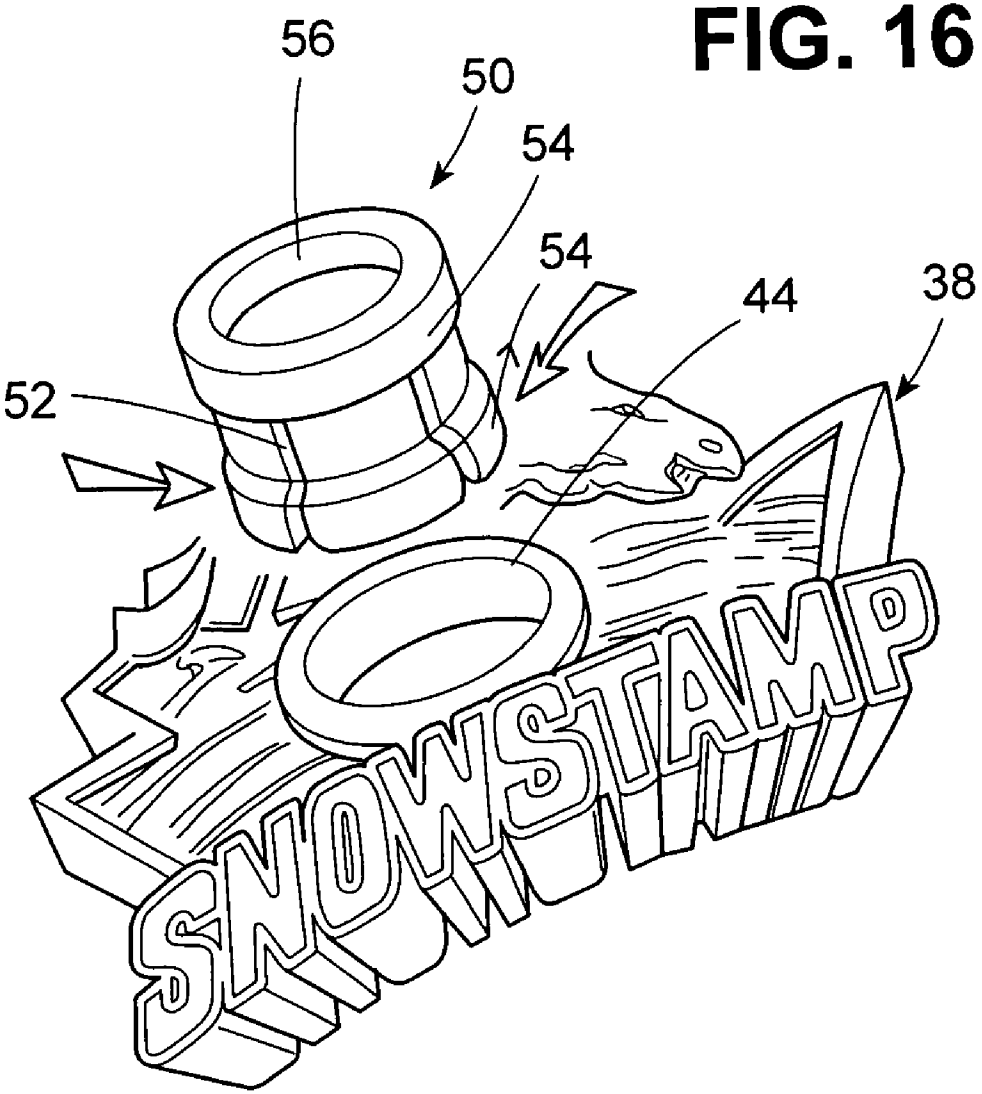
FIG. 16 is an isometric, exploded top view of a ski pole disc and insert.

As shown in FIG. 16, an insert 50 may be provided that fits into the central opening 44 of the ski pole disc 38 to enable the disc to be firmly engaged with the bottom end portion 24 of the ski pole 18. The insert 50 may be a hollow cylinder with longitudinal slots 52 at one end to provide flexibility, so that it can be inserted into the central opening 44 of the disc 38. The ends of the insert may have circumferential rims 54 that are larger in diameter than the central opening 44 to allow the insert to lock into position in the disc 38. Once the insert 50 is installed in the disc 38, the bottom end portion 24 of the ski pole 18 is inserted through in the center 56 of the insert 50. Because ski poles vary in diameter and shape, inserts of various sizes and configurations may be provided with each disc to allow the disc to be installed on a variety of different ski poles.

There are numerous systems for removably securing a ski pole disc 38 to the bottom end 24 of a ski pole 18, and it is understood that the present invention can employ any known attachment method. Further, the ski pole disc of the present invention may be more or less permanently secured to the bottom end portion of ski poles, instead of being removable. However, in the preferred arrangement, the ski pole discs are designed for replaceable use in combination with ski poles, so that the owner of a set of ski poles can have more than one set of ski pole discs to selectively impart different images. The disc 38 may be removed by applying a downward force and possibly a twisting force to the disc 38 and insert 50 assembly and sliding the assembly off the bottom end 24 of the ski pole 18.

The replaceable nature of the ski pole disc allows the user to periodically change the disc in accordance with the user's tastes. For example, a particular disc may be selected to mark an occasion, such as a win by a favorite sports team. As a further example, discs having advertising images may be sold to or given to skiers or may be attached to rental ski poles to encourage skiers to disseminate advertising information. Also, it may be desirable to attach discs having the illumination features only at night.

As noted above, the present invention includes methods of imparting information using a disc attachable to a ski pole. In certain embodiments, the disc is selected based on a configuration of a bottom surface of the disc, which forms an image in the snow that imparts information to a person viewing the formed image. Alternatively, the disc may be selected for attachment to the ski pole based on a configuration of a top surface of the disc, which imparts information to a person viewing the top surface, or based on the configuration of both the top and bottom surfaces.

The present invention also includes methods of advertising, in which a ski pole disc is formed having an advertising image on a bottom surface of the disc. The bottom surface is configured to impress the advertising image in the snow. The ski pole disc is provided to a user and is removably attached to a ski pole by the user. Alternatively, the ski pole disc may be formed to have an advertising image on a top surface of the disc, which is configured to impart the advertising image to a person viewing the top surface, or on both the top and bottom surfaces.

What is claimed is:

1. A ski pole disc for attachment to a ski pole, the ski pole disc comprising:

a body extending in a direction substantially perpendicular to the ski pole and having a hole in a central portion thereof to receive the ski pole;

an electronic circuit positioned in the body, wherein the body is configured to allow illumination generated by the electronic circuit to be visible through the body, and the body comprises a housing, which comprises;

a bottom housing element having a top surface and a bottom surface and having a hole in a central portion thereof to receive the ski pole; and a top housing element having a top surface and a bottom surface and having a hole in a central portion thereof to receive the ski pole, wherein the top housing element cooperates with the bottom housing element to house the electronic circuit.

2. The ski pole disc of claim 1, wherein the electronic circuit comprises a motion-activated circuit, and the illumination is initiated in response to a signal from the motion-activated circuit.

3. The ski pole disc of claim 2, further comprising a sound generation circuit, and the generation of sound by the sound generation circuit is initiated in response to a signal from the motion-activated circuit.

4. The ski pole disc of claim 1, wherein the electronic circuit comprises a temperature detection circuit, and the illumination is initiated in response to a signal from the temperature detection circuit.

5. The ski pole disc of claim 1, wherein the electronic circuit comprises a light-level detection circuit, and the illumination is initiated in response to a signal from the light-level detection circuit.

6. The ski pole disc of claim 1, further comprising a sound generation circuit.

7. The ski pole disc of claim 1, wherein the electronic circuit is sealed within the body to prevent contact with water.

8. The ski pole disc of claim 1, wherein the bottom housing element and the top housing element have respective edge portions that are substantially the same size and shape, and the edge portions are sealed together to prevent water from entering the housing.

9. The ski pole disc of claim 1, wherein the housing comprises an inner surface substantially perpendicular to the ski pole and having a plurality of recessed portions configured to hold elements of the electronic circuit.

10. The ski pole disc of claim 1, wherein the bottom housing element is configured to allow the illumination generated by the electronic circuit to be visible through the bottom housing element.

11. The ski pole disc of claim 1, wherein the body further comprises a resistance layer attached to the housing and extending beyond the housing in a direction substantially perpendicular to the ski pole.

12. The ski pole disc of claim 11, wherein the top housing element and the resistance layer are configured to allow the illumination generated by the electronic circuit to be visible through the top housing element and the resistance layer.

13. The ski pole disc of claim 11, wherein the resistance layer and the housing both are formed of plastic, and the resistance layer is formed of a softer plastic than the housing.

14. The ski pole disc of claim 11, wherein the resistance layer is formed on the top surface of the top housing element by injection molding.

15. The ski pole disc of claim 11, wherein the resistance layer is formed on the bottom surface of the bottom housing element by injection molding.

16. The ski pole disc of claim 11, wherein the resistance layer is formed around the housing by injection molding to at least partially cover the top surface of the top housing element and the bottom surface of the bottom housing element.

17. The ski pole disc of claim 11, wherein the resistance layer is configured to form an image in the snow that imparts information to a person viewing the formed image.

18. The ski pole disc of claim 11, wherein the resistance layer is configured to impart information to a person viewing a top surface of the resistance layer.

19. The ski pole disc of claim 1, wherein the electronic circuit comprises:

at least one light-emitting device; and a processor configured to control the light-emitting device.

20. The ski pole disc of claim 19, wherein the electronic circuit further comprises a motion-activated circuit, and the light-emitting device is activated in response to a signal from the motion-activated circuit.

21. The ski pole disc of claim 20, wherein the electronic circuit comprises a plurality of light-emitting devices, and the processor activates the light-emitting devices in a predetermined sequence.

22. The ski pole disc of claim 19, wherein the light-emitting device is a light emitting diode (LED).

23. The ski pole disc of claim 19, wherein the electronic circuit further comprises a power source connected to provide power to the light-emitting device and the processor.

24. The ski pole disc of claim 23, wherein the power source comprises a battery.

25. The ski pole disc of claim 23, wherein the power source comprises a plurality of batteries arranged around a periphery of the housing.

26. The ski pole disc of claim 23, wherein the power source comprises a plurality of batteries arranged in a stack.

27. The ski pole disc of claim 23, wherein the power source comprises a solar cell connected to recharge the power source.

28. A ski pole disc for attachment to a ski pole, the ski pole disc comprising:

a body extending in a direction substantially perpendicular to the ski pole and having a hole in a central portion thereof to receive the ski pole;

an electronic circuit positioned in the body, wherein the body is configured to allow illumination generated by the electronic circuit to be visible through the body, and wherein the electronic circuit comprises:

at least one light-emitting device; and a processor configured to control the light-emitting device, wherein the electronic circuit is formed on a plurality of printed circuit boards arranged around a periphery of the body.

29. The ski pole disc of claim 28, wherein each of the printed circuit boards has a plurality of light-emitting devices arranged thereon.

30. The ski pole disc of claim 29, wherein the plurality of light-emitting devices arranged on each of the printed circuit boards includes a variety of colors.

31. The ski pole disc of claim 28, wherein the electronic circuit further comprises a motion-activated circuit, and the light-emitting device is activated in response to a signal from the motion-activated circuit.

32. The ski pole disc of claim 28, wherein the electronic circuit comprises a plurality of light-emitting devices, and the processor activates the light-emitting devices in a predetermined sequence.

33. The ski pole disc of claim 28, wherein the light-emitting device is a light emitting diode (LED).

34. The ski pole disc of claim 28, wherein the electronic circuit further comprises a power source connected to provide power to the light-emitting device and the processor.

35. The ski pole disc of claim 34, wherein the power source comprises a battery.

36. The ski pole disc of claim 34, wherein the power source comprises a plurality of batteries arranged around a periphery of the body.

37. The ski pole disc of claim 34, wherein the power source comprises a plurality of batteries arranged in a stack.

38. The ski pole disc of claim 34, wherein the power source comprises a solar cell connected to recharge the power source.

* * * * *